US008535407B2

(12) United States Patent
Konyashin et al.

(10) Patent No.: US 8,535,407 B2
(45) Date of Patent: Sep. 17, 2013

(54) HARD-METAL

(75) Inventors: Igor Yuri Konyashin, Burghaun (DE); Bernd Heinrich Ries, Burghaun (DE); Frank Friedrich Lachmann, Burghaun (DE)

(73) Assignee: Element Six GmbH, Burghaun (DE)

( * ) Notice: Subject to any disclaimer, the term of this patent is extended or adjusted under 35 U.S.C. 154(b) by 21 days.

(21) Appl. No.: 13/062,544

(22) PCT Filed: Sep. 15, 2009

(86) PCT No.: PCT/IB2009/054024

§ 371 (c)(1),
(2), (4) Date: May 9, 2011

(87) PCT Pub. No.: WO2010/029518

PCT Pub. Date: Mar. 18, 2010

(65) Prior Publication Data

US 2011/0212825 A1 Sep. 1, 2011

(30) Foreign Application Priority Data

Sep. 15, 2008 (GB) ..... 0816837.9

(51) Int. Cl.

| | |
|---|---|
| ***C22C 26/00*** | (2006.01) |
| ***C22C 29/02*** | (2006.01) |
| ***C22C 29/14*** | (2006.01) |
| ***C22C 1/05*** | (2006.01) |
| ***C22C 32/00*** | (2006.01) |
| ***B22F 3/12*** | (2006.01) |

(52) U.S. Cl.
USPC ..... 75/236; 75/238; 75/239; 75/240; 75/242; 75/244; 419/11; 419/13; 419/14; 419/16; 419/38

(58) Field of Classification Search
USPC ..... 75/236, 238, 239, 240, 242, 244; 419/11, 13, 14, 17
See application file for complete search history.

(56) References Cited

U.S. PATENT DOCUMENTS

| | | | | |
|---|---|---|---|---|
| 1,996,598 | A | 4/1935 | Taylor et al. | |
| 3,496,682 | A * | 2/1970 | Quaas et al. | 75/252 |
| 3,725,016 | A | 4/1973 | Mai et al. | |
| 3,836,341 | A | 9/1974 | Saltzman et al. | |
| 4,378,975 | A | 4/1983 | Tomlinson et al. | |
| 4,743,515 | A | 5/1988 | Fischer et al. | |
| 4,820,482 | A | 4/1989 | Fischer et al. | |
| 5,066,553 | A | 11/1991 | Yoshimura et al. | |
| 5,623,723 | A | 4/1997 | Greenfield | |
| 5,648,119 | A | 7/1997 | Grab et al. | |
| 5,660,939 | A | 8/1997 | Burdett | |
| 5,723,177 | A | 3/1998 | Brandrup-Wognsen et al. | |
| 5,755,299 | A | 5/1998 | Langford, Jr. et al. | |
| 5,856,626 | A | 1/1999 | Fischer et al. | |
| 6,066,553 | A | 5/2000 | Sandhu et al. | |
| 6,372,012 | B1 * | 4/2002 | Majagi et al. | 75/236 |
| 6,709,065 | B2 | 3/2004 | Peay et al. | |
| 7,172,256 | B2 | 2/2007 | Sleep et al. | |
| 7,204,560 | B2 | 4/2007 | Mercier et al. | |
| 7,427,310 | B2 | 9/2008 | Tillman et al. | |
| 7,879,129 | B2 | 2/2011 | Kosters et al. | |
| 2006/0093859 | A1 | 5/2006 | Konyashin et al. | |
| 2007/0051354 | A1 | 3/2007 | Sung | |
| 2007/0193782 | A1 * | 8/2007 | Fang et al. | 175/374 |
| 2008/0240879 | A1 | 10/2008 | Dourfaye et al. | |
| 2008/0302576 | A1 * | 12/2008 | Mirchandani et al. | 175/425 |

FOREIGN PATENT DOCUMENTS

| | | |
|---|---|---|
| DE | 531077 | 8/1931 |
| DE | 3618198 | 5/1986 |
| DE | 4419996 | 4/1995 |
| EP | 0774527 | 6/2002 |
| EP | 1029629 | 1/2004 |
| EP | 1548136 | 3/2008 |
| GB | 0611860 | 11/1948 |
| GB | 1031432 | 6/1966 |
| GB | 1506915 | 4/1978 |
| GB | 2167088 | 5/1986 |
| JP | 5867803 | 4/1983 |
| JP | 5873762 | 4/1983 |
| JP | 63220912 | 9/1988 |
| JP | 2001040446 | 2/2001 |
| JP | 2002209448 | 7/2002 |
| JP | 2003193172 | 7/2003 |
| JP | 2003225755 | 8/2003 |
| JP | 2004131769 | 4/2004 |
| JP | 2004337046 | 12/2004 |
| JP | 2005009510 | 1/2005 |
| JP | 2008073694 | 4/2008 |
| KR | 200470448 | 7/2005 |
| SE | 192637 | 11/1964 |
| SU | 1006196 | 3/1983 |
| WO | 2005017317 | 2/2005 |
| WO | 2005106183 | 11/2005 |
| WO | 2006080302 | 8/2006 |
| WO | 2008076689 | 6/2008 |
| WO | 2010029518 | 3/2010 |
| WO | 2010029522 | 3/2010 |

OTHER PUBLICATIONS

Patent Cooperation Treaty, Search Report for PCT/IB2009/054024, Nov. 18, 2009.
United Kingdom Intellectual Property Office, Search Report for GB0816837.9, Dec. 31, 2009.
Roebuck, Magnetic moment (saturation) measurements on hard-metals, International Journal of Refractory and Hard Materials, 1996, pp. 419-424, vol. 14.
Mari, D and Clausen, B, Measurement of residual thermal stress in WC-Co by neutron diffraction, International Journal of Refractory and Hard Materials, 2009, pp. 282-287, vol. 27.

* cited by examiner

*Primary Examiner* — Roy King
*Assistant Examiner* — Ngoclan T Mai
(74) *Attorney, Agent, or Firm* — Bryan Cave LLP

(57) ABSTRACT

The invention relates to a hard-metal comprising at least 13 volume % of a metal carbide selected from the group consisting of TiC, VC, ZrC, NbC, MoC, HfC, TaCl WC or a combination thereof, a binder phase comprising one or more of iron-group metals or alloy thereof and 0.1 to 10 weight % Si and 0.1 to 10 weight % Cr and having a liquidus temperature at 1280 degrees C. or lower and 3 to 39 volume % of diamond or cBN grains coated with a protective coating or a mixture thereof and a process for making the hard-metal.

17 Claims, 5 Drawing Sheets

(a)

(b)

HARD-METAL

CROSS-REFERENCE TO RELATED APPLICATIONS

This application was filed under 35 U.S.C. §371 as a National Stage application of PCT International Application Serial No. PCT/IB2009/054024, filed Sep. 15, 2009. PCT International Application Serial No. PCT/IB2009/054024 claims priority to UK Patent Application GB 0 816 837.9, filed Sep. 15, 2008, which is incorporated herein by reference in its entirety.

INTRODUCTION

This invention relates to the field of hard-metals, such as may be used in wear parts. Such parts may be used in a wide variety of applications such as earth boring, excavating, oil and gas drilling, construction, cutting of stone, rock, metals, wood and composite materials, and chip-forming machining.

BACKGROUND TO THE INVENTION

Cemented carbide, also called hard-metal, is class of hard material comprising a hard phase of metal carbides and/or carbo-nitrides, the metal being selected from groups IVa to VIa of the periodic table and a metallic alloy binder comprising one or more iron-group metals. Hard-metals are produced by a powder metallurgy method typically including the steps of milling, mixing, pressing and liquid-phase sintering. The sintering temperatures of the most commonly used WC—Co hard-metals are usually above the melting point of a eutectic temperature, which is in the range of about 1300 deg. C. to 1320 deg. C. The sintering temperatures used for another class of hard-metals called cermets and comprising TiC or TiCN with a Ni—Mo-based binder, are above the melting point in the Ti—C—Ni—Mo system of roughly 1280 deg. C. Typically the sintering temperatures for hard-metals are above 1350 deg. C., which allows the formation of a large fraction of liquid phase during sintering in order to promote full density of the sintered product.

The term "wear part" is understood to mean a part or component that is subjected, or intended to be subjected to wearing stress in application. There are various kinds of wearing stress to which wear parts may typically be subjected such as abrasion, erosion, corrosion and other forms of chemical wear. Wear parts may comprise any of a wide variety of materials, depending on the nature and intensity of wear that the wear part is expected to endure and constraints of cost, size and mass. For example, cemented tungsten carbide is highly resistant to abrasion but due to its high density and cost is typically used only as the primary constituent of relatively small parts, such as drill bit inserts, chisels, cutting tips and the like. Larger wear parts may be used in excavation, drill bit bodies, hoppers and carriers of abrasive materials and are typically made of hard steels which are much more economical than cemented carbides in certain applications.

US Patent Publication No. 2007/0092727 teaches a wear part comprising diamond grains, a carbide phase such as tungsten carbide and a metallic alloy with liquidus temperature less than 1,400 deg. C. and preferably less than 1,200 deg. C. Two methods are taught for making the wear parts. In the first method an intermediate article comprising diamond grains is contacted with a source of both a selected infiltrant first alloy and a selected second alloy, the temperature of the source and intermediate article is raised to above the liquidus of the infiltrant alloy, causing the latter to infiltrate into the pores of the intermediate article. Carbides are formed when components of the second alloy react with the diamond of the intermediate article. In the second method, which is more suitable for making larger wear parts, an intermediate material comprising diamond grains and an alloy selected from the first group and an alloy from the second group is subjected to hot pressing at a temperature lower than 1,200 degrees Centigrade (deg. C.). No infiltration is required in the second method.

Stainless steel alloys developed for the nuclear industry are taught in U.S. Pat. No. 5,660,939 and GB Patent No. 2,167,088, for example, and comprise chromium, nickel, silicon and carbon, but positively do not contain cobalt, which is generally unsuitable for use in a radio-active environment. These alloys are both hard and corrosion resistant.

Materials comprising uncoated diamond grains dispersed within in a hard-metal matrix are disclosed in a number of patents, for example U.S. Pat. No. 1,996,598, GB Patent No. 611,860, German Patent No., 531,077 and Swedish Patent No. 192,637.

The use of diamond grains coated with a layer of a refractory metal carbide, nitride, oxide, boride, suicide or combination thereof as components of hard-metals is described in U.S. Pat. No. 5,723,177. These coatings on diamond grains are believed to suppress or retard graphitisation of the diamond during sintering. However, the above mentioned U.S. patent discloses only conventional hard-metals with relatively high liquidus temperatures at which graphitisation or other degradation of the diamond is accelerated or promoted. For this reason, the diamond-containing hard-metal has to be sintered without the formation of a liquid phase, i.e. at temperatures lower than about 1300 deg. C. Each article comprising the hard-metal as described above has to be hot-pressed individually by means of an axial press in order to obtain a sufficiently high density, in contrast to the more economical conventional batch method of sintering hard-metal articles in large furnaces. Consequently, articles produced according to the teaching of this patent have relatively high production costs. An additional disadvantage of sintering without a liquid phase is that the optimal microstructure and complete elimination of residual porosity within the material cannot be obtained.

Another patent describing a hard-metal comprising coated diamond grains is Japanese Patent No. 2001040446. This reference discloses a hard-metal with a binder comprising Fe-group metals and again, it is taught that the sintering temperatures should be relatively low (nearly 1300 deg. C.) in order to prevent full melting of the binder phase. As a result, the optimal microstructure and full density of the material cannot be obtained.

There are a number of references disclosing diamond-containing hard-metals characterised by a low temperature liquid phase formation. U.S. Patent Publication No. US 2007/0092727 describes a diamond-containing hard-metal comprising a carbide phase and a binder phase comprising a metallic or inter-metallic alloy with a liquidus temperature of less than 1400 deg. C., preferably 1200 deg. C. The diamond grains are not coated so that even at relatively low sintering temperatures the diamond grains, being in contact with the liquid binder containing Fe-group metals, would tend to graphitise.

PCT Patent Application No. PCT/JP2006/301033 describes a diamond-containing hard-metal, the binder of which comprises 0.01 to 2.0 wt % of phosphorus to reduce the temperature of liquid phase formation. A disadvantage of this hard-metal is that, even at high phosphorus content, the binder phase is only partially molten, which tends to result in some residual porosity.

There is thus a need to provide improved metallurgical formulations, particularly hard metals, that result in reduced degradation of diamond or other ultra-hard abrasives such as CBN grains where incorporated. It is desirable that the hard-metal be produced at pressures equal to or lower than atmospheric pressure without using hot-pressing, which would allow the mass-production at low costs.

SUMMARY OF THE INVENTION

According to a first aspect of the invention there is provided a hard-metal comprising at least 13 volume % of a metal carbide selected from the group consisting of TIC, VC, ZrC, NbC, MoC, HfC, TaC, WC or a combination thereof and a binder phase comprising one or more of an iron-group metal or an alloy thereof and 0.1 to 10 wt. % Si and 0.1 to 10 wt. % Cr and having a liquidus temperature at 1280 deg. C. or lower and 3 to 39 volume % of diamond or CBN coated with a protective coating or a mixture thereof.

Preferably the liquidus temperature of the binder phase is less than 1250 deg. C., more preferably less than 1160 deg. C.

Preferably the binder phase additionally comprises 1 to 20 weight percentage (wt. %) of dissolved carbon.

Preferably the Cr is present in the form of chromium carbide and/or a solid solution in the binder phase.

The hard-metal according to the invention preferably includes the Cr present in the form of a metal Cr complex carbide $(Me,Cr)_xC_y$ where Me is Fe, Co and/or Ni, x is 1 to 23 and y is 1 to 6.

Preferably the Si is present in the form of a solid solution in the binder phase or in the form of a silicide of Co, Ni and/or Fe.

Preferably the binder phase additionally comprises up to 10 weight % of B, Al, S and/or Re.

The diamond and/or cBN grains preferably have an average size within the range of 1 to 500 microns. These diamond and/or CBN grains are coated with a protective coating. The protective coating shields the diamond and CBN from attack by the binder phase during sintering reducing degradation of the grain. The coating is preferably a coating of a carbide, carbonitride or nitrides of a metal of the IVa to VIa groups of the periodic table and will generally be of more than 0.2 μm in thickness. Preferably the protective coating comprises a single layer or multilayers consisting of a metal or metals of the IVa to VIa groups of the periodic table and/or their carbides, carbonitrides or nitrides, the coating having an average thickness of at least 0.2 μm Preferably the binder phase is a low, medium or high-alloyed steel.

Preferably the hard-metal according to the invention has a density equal to or higher than 99.5% of the theoretical density.

The hard-metal according to the invention preferably includes a microstructure comprising:

- rounded grains of (Cr,Me)xCy, wherein Me, x and y are as defined above, of average size within the range of 1 to 30 μm;
- a carbide phase of either rounded or facetted grains of average size within the range of 0.2 to 20 μm; and
- a metal based phase consisting of a solid solution of C, Cr, Si and components of the carbide phase in Me, where Me is Fe, Co and/or Ni.

The rounded grains of (Cr,Me)xCy may have a brown or yellow colour on a metallurgical cross-section after etching in the Murakhami reagent at room temperature for 5 minutes or longer.

According to a second aspect of the invention, a process for producing a hard metal according to the first aspect of the invention includes the steps of:

- providing a blend of powders comprising at least 13 vol. % of a metal carbide, 0.1 to 10 wt. % Si and 0.1 to 10 wt. % Cr and an iron group metal or alloy thereof;
- providing diamond or cBN grains coated with a protective coating which coating is preferably a carbide, nitride and/or carbonitride coating or a mixture thereof;
- admixing a quantity of the diamond or cBN grains or mixture thereof into the blend of powders to form a mixture;
- compacting the mixture to form a green article; and
- sintering the green article at less than atmospheric pressure or in an inert atmosphere at a temperature not greater than 1250 deg. C.

For many applications, particularly when the hard metal is provided as a coating on a component of complex shape such as a mining pick, the green article is preferably sintered at elevated temperature for short period of no longer than five minutes. More preferably the sintering at the elevated temperature is for a period of no longer than 3 minutes and still more preferably for a period of no longer than 2 minutes. The minimum period of sintering at the elevated temperature is usually 30 seconds.

Preferably the sintering temperature is no greater than 1160 deg. C.

BRIEF DESCRIPTION OF THE DRAWINGS

Preferred embodiments of the invention will be described by way of non-limiting examples, and with reference to the accompanying drawings in which.

SPECIFIC DESCRIPTION OF THE INVENTION

Figure 1:
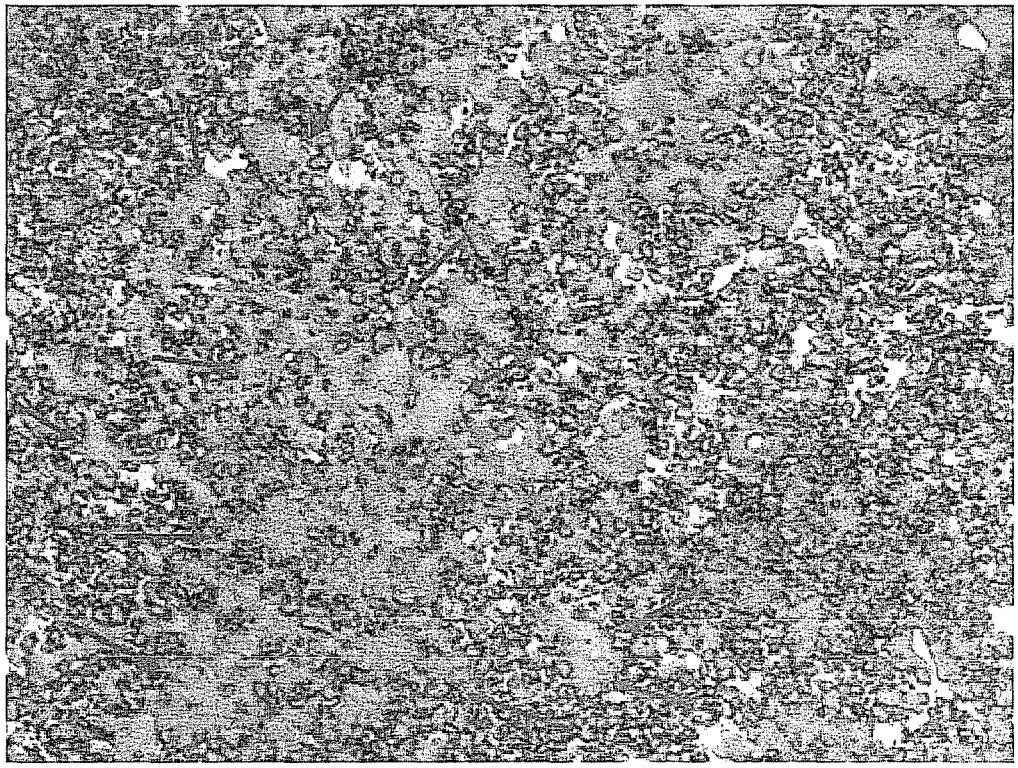
FIG. 1 shows the microstructure of a hard-metal of WC and Co—Cr—Si—C sintered at 1160 deg. C for 5 minutes

The term "metallic alloy", or more simply "alloy", is understood to mean a material that comprises at least one metal and has a metallic, semi-metallic or inter-metallic character. It may additionally comprise a ceramic component.

The present invention provides a hard-metal comprising grains of carbide and and an ultra-hard phase and a metal binder phase comprising an iron group metal, such as iron, cobalt or nickel or alloy thereof, as well as silicon and chromium. In a preferred embodiment of the present invention, grains of one or more types of refractory metal carbide are dispersed within the binder phase and in a particularly preferred embodiment WC or TiC or a combination thereof, is present in the hard-metal in an amount within the range of about 40 to about 80 wt. %. The carbide grains preferably have a mean equivalent diameter in the range 1 to 30 microns and more preferably in the range 3 to 20 microns.

An ultra-hard phase such as diamond and/or cBN is additionally present in the hard-metal. In one form of the invention this ultra-hard phase is present in an amount within the range of about 5 to 30 volume %, the carbide is WC or TiC or a combination thereof and is present in an amount within the range of about 24 to about 63 wt. %. The binder phase may typically comprise a cobalt-iron alloy with dissolved silicon, tungsten, chromium and titanium.

It has been found that in the Me—Cr—Si—C system (where Me is Co, Ni or Fe) there is a low melting point eutectic of below 1280 deg. C., preferably below 1250 deg. C. and most preferably below 1160 deg. C. The eutectic composition has the desirable property that the melt readily wets certain carbides, especially TiC, VC, ZrC, NbC, MoC, HfC, TaC, WC and can effectively infiltrate a porous carbide preform during liquid-phase sintering at low temperatures within a relatively short time. Thus, the hard-metal based on the refractory carbides with the binder of the Me—Cr—Si—C system can be sintered to full density at very low temperatures. The hard-metals obtained in such a way have a combination of high mechanical and performance properties comparable with that of conventional WC—Co hard-metals. In a preferred embodiment, Co, $Cr_3C_2$ and Si are present in the weight % ratio 75:2:5, or about this ratio. Differential thermal analysis has indicated that this system melts at between 1140 and 1150 deg. C.

As a consequence of the low temperature of formation of liquid phase within the hard-metal formulation of the present invention, diamond or CBN grains may be incorporated within the hard-metal formulation without the disadvantage of substantial diamond degradation or residual porosity. The diamond grains are pre-coated with protective coatings preferably comprising a carbide, carbonitride or nitride of a metal of the IVa to IVa groups of the periodic table. A preferred coating is TiC with an average thickness of about 1 μm, deposited by chemical vapour deposition (CVD) from TiCl4-CH4-H2 gas mixtures in a rotating tube, as is well known in the art.

The combination of the protective coating(s) on the diamond grains together with low sintering temperatures and a short sintering time prevents or retards the degradation of the diamond or CBN grains. In the case of diamond, for example, there is a prevention or retardation of the process of thermally-promoted graphitisation whereby diamond converts to the soft graphitic form of carbon. A second function of the coating of the grains may be that it promotes superior bonding and retention of the grains within the hard facing (wear resistant) material, and a third function may be to prevent or retard the reaction of certain metallic phases with the grains, such as iron, with the diamond. As a result, the diamond or CBN-bearing hard-facing material has exceptional mechanical properties and wear performance. In the case of diamond it has been found that the abrasive wear resistance of the coatings exceeds that of WC—Co hard-metals by a factor of 100 or more. In order to obtain these high wear-resistances the diamond-containing hard-metals should comprise at least 3 vol. % or about 10 wt. % diamond or CBN.

The hard-metal of the invention may be produced by mixing and/or milling of a powder blend comprising powders of the hard-metal constituents and pre-coated diamond grains, compacting the powder blend at a temperature not necessarily substantially above ambient temperature to form a "green" article and sintering the green article in a furnace at lower than atmospheric pressure or in an inert atmosphere at a temperature below 1250 deg. C., preferably below 1200 deg. C. and most preferably below 1160 deg. C. for not longer than 5 min, and preferably until full density of the article is achieved.

The production process for the diamond or CBN-containing hard-metal does not include expensive hot-pressing of each article in graphite dies and can be easily employed for large-scale and cost-effective fabrication of diamond-containing hard-metals. The diamond or CBN-containing hard-metals obtained in such a way can be employed for metal-cutting, mining, wear-resistant parts and the like.

FIG. 1 illustrates the rounded grains of $(Cr,Co)_xC_y$, which have a brown colour after etching in the Murakhami reagent, are indicated by arrows. The microstructure comprises faceted WC grains of nearly 0.5 to 5 μm, rounded grains of (Cr,Co)xCy of nearly 1 to 10 μm and interlayers of the Co-based binder among them.

Figure 2:
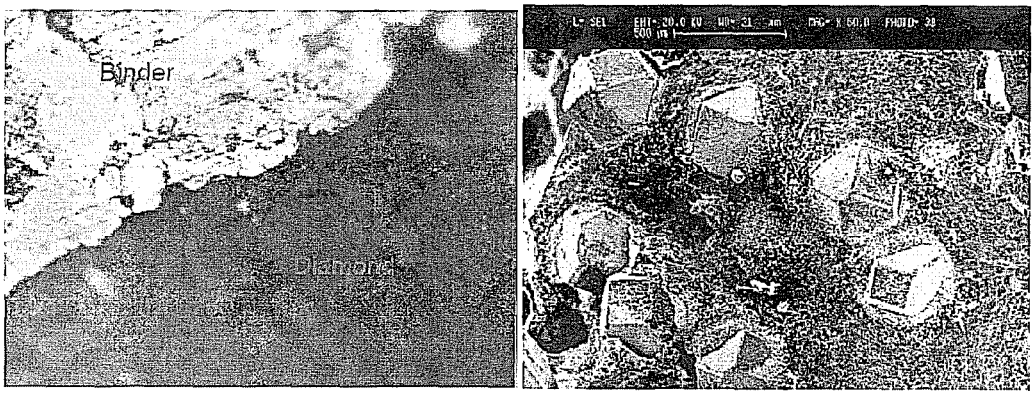
FIG. 2 shows fracture surface of a sample comprising TiC coated diamond (300-400 um, TC3B) after sintering with Co—Cr—Si—C binder at 1160 deg. C. for 5 minutes.
Figure 3:
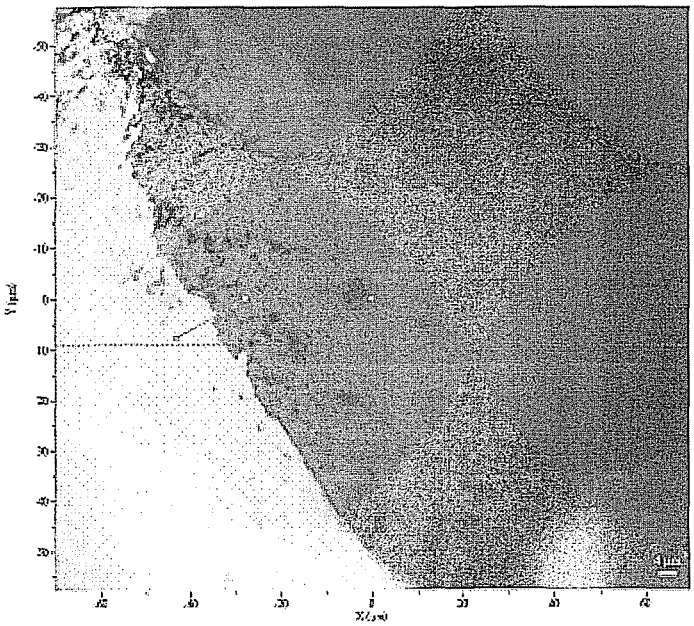
FIG. 3*a* shows the interface between the coated diamond grain and the binder as well the line at which Raman spectra for FIG. 3*b* were taken.
FIG. 3*b* shows results of Raman spectroscopy at the interface between TiC coated diamond and the Co—Cr—Si—C binder sintered at 1160 deg. C. for 5 minutes, indicating that there is no graphite at the interface.
Figure 3:
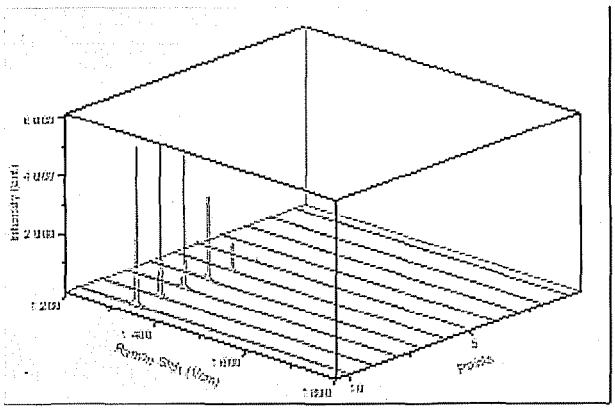

FIGS. 2 and 3 illustrate the substantial absence of graphitisation of the diamond particles incorporated in a hard metal of the invention. Referring to FIG. 2, it can be seen that the coated diamond grains are well-facetted and shiny, which indicates, that they have not been graphitised during sintering. From FIG. 3*b* it can be seen that on the left hand side the spectra comprise only peaks typical for diamond at nearly 1320 $cm^{-1}$ and no other peaks. When going further from left to right toward the diamond-coating-binder interface the diamond peaks become weaker. The Raman spectra do not comprise any signals being taken from the coating or binder surface, which is typical for carbides, metals and alloys. Note that there are no peaks except for the diamond peak at the diamond-coating-binder interface, especially peaks at nearly 1500 $cm^{-1}$ to 1600 $cm^{-1}$ typical for graphite, indicating that there is no graphite at the diamond-coating-binder interface.

The invention will now be described with reference to the following (non-limiting) Examples, which are to be considered as illustrative to the present invention. It should be understood, however, that the invention is not limited to the specific details of the Examples. Example 1 illustrates hard metal with carbide and a binder phase suitable for incorporating diamond or CBN grains to produce a hard metal of the invention. Example 2 illustrates a hard metal containing diamond grains.

EXAMPLE 1

A 1 kg batch of powders comprising 70 wt. % WC powder with a mean diameter of about 0.8 μm, 22.5 wt. % Co powder, 6% $Cr_3C_2$ powder and 1.5 wt. % Si powder was milled for six hours in an attritor mill in a medium of hexane and 20 g paraffin wax and 6 kg hard-metal balls. After milling, the resulting slurry was dried and the powder was screened to eliminate agglomerates. The screened powder was compacted by means of a conventional cold press to form cylindrically-shaped samples, which were sintered at 1160 deg. C. in vacuum for 1 min. The sintered samples had a density of 12.4 $g/cm^3$, hardness (HV30) of 250, fracture toughness of 14.6 MPa m½ and transverse rupture strength of 2700 MPa. These properties are comparable with conventional WC—Co hard-metals having a similar binder content. The microstructure of the sample comprised facetted WC of 1 to 2μm, grains comprising a mixture of rounded of $(Cr,Co)_7C_3$ and $(Cr,Co)_{23}C_6$ of 1 to 10 μm and the binder on the basis of Co with some dissolved C, Cr and Si. The rounded grains of $(Cr,Co)_7C_3$ and $(Cr,Co)_{23}C_6$ had a yellowish colour after etching the metallurgical cross-section in the Murakhami reagent for 2 minutes.

The presence of Si in the binder was found to increase its resistance to oxidation, as shown in FIG. 1.

EXAMPLE 2

A 1 kg batch of powders comprising 67 wt. % WC powder with a mean diameter of about 0.8 μm, 24 wt. % Co powder, 6.4% $Cr_3C_2$ powder and 1.6 wt. % Si powder was milled for six hours in an attritor mill in a medium of hexane and 20 g paraffin wax and 6 kg hard-metal balls. After milling, the resulting slurry was dried and the powder was screened to eliminate agglomerates. Diamond grains with mean diameter in the range 300 to 400 um and having a TIC coating with average thickness about 0.5 um were introduced to the resulting powder at a level of 7 wt. %, and blended into the powder by means of a Turbular mixer. The weight percentage of diamond added was calculated to correspond to 20 vol. % diamond in the final sintered product. So, at this stage the mixture comprised 63 wt % WC, 22.5 wt. % Co, 7 wt. % diamond grains, 6 wt. % $Cr_3C_2$ and 1.5 wt. % Si.

The powder mixture was compacted by means of a conventional cold press to form cylindrically-shaped samples, which were sintered at 1160 deg. C. in vacuum for 1 min. The microstructure of the sample comprised facetted WC of 1 to 2 μm, rounded grains comprising a mixture of $(Cr,Co)_7C_3$ and $(Cr,Co)_{23}C_6$ of 1 to 10 μm and the binder on the basis of Co with some dissolved C, Cr and Si. The rounded grains of $(Cr,Co)_7C_3$ and $(Cr,Co)_{23}C_6$ had a yellowish colour after etching the metallurgical cross-section in the Murakhami reagent for 2 minutes. Thin foils suitable for transmitted electron microscopy (TEM) were prepared from the sintered sample and subjected to TEM, SEM, Raman spectroscopy and optical microscopy. This analysis revealed no measurable graphitisation of the diamond grains.

The wear-resistance of the sintered sample was examined by using a modified ASTM B611 test, whereby a diamond grinding wheel comprising diamond grains of 150 μm in a resin binder was used instead of a steel wheel and no alumina grit was employed. A fine-grain hard-metal grade with 4% Co was employed as a control. After carrying out the test, the wear of the hard-metal control was equal to $1.7\times10-4$ $cm^3$/rev, whereas that of the diamond-containing hard-metal was equal to $1.5\times10-6$ $cm^3$/rev. In other words, the wear-resistance of the diamond-containing hard-metal was more than two orders of magnitude greater than that of the hard-metal control.

EXAMPLE 3

Figure 4:
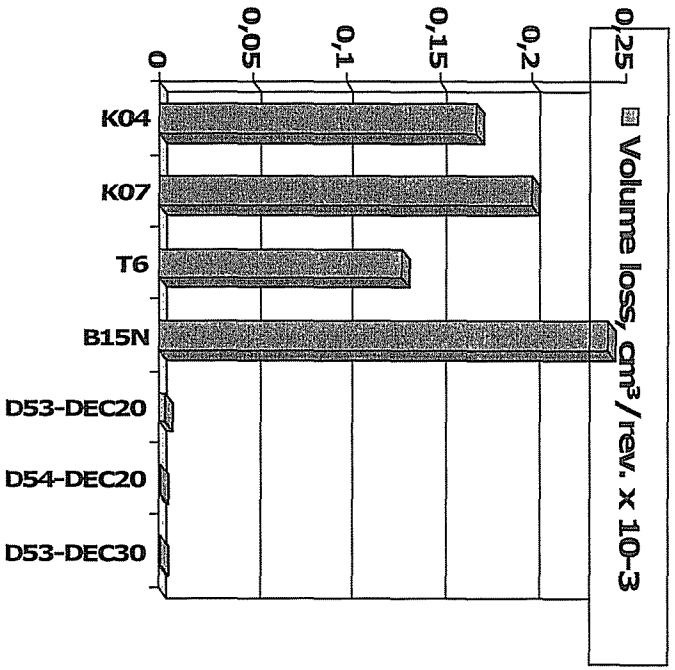
FIG. 4 shows the results of a Sliding Test of diamond-containing hard-metals with the Co—Cr—Si—C binder and various hard metals against diamond grinding wheel.
Figure 5:
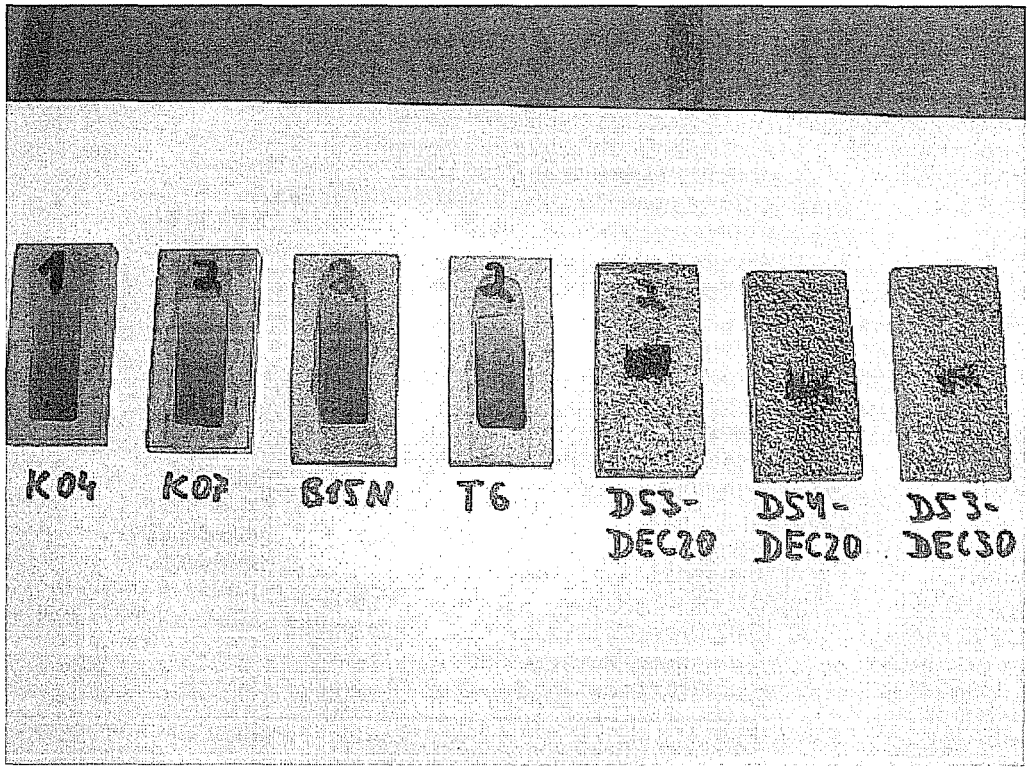
FIG. 5 shows the wear of DEC with the Co—Cr—Si—C binder in comparison with WC—Co hard-metals after carrying out the sliding wear test, results of which are shown in FIG. 4.

Various diamond containing hard metals were produced using the process of Example 2. These diamond containing hard metals and other hard metals were subjected to a sliding test against a commercially available diamond grinding wheel. The sliding test was carried out in a similar way to the ASTM B611 wear test, except that a diamond grinding wheel is employed instead of a steel wheel and no alumina particles are used. The hard-metal wear was measured by weighing the samples before and after testing and the revolution number was 1000. The diamond grinding wheel having a designation of 1A1-200-20-10-16 was from the Wuxi Xinfeng Diamond Tolls Factory (China). The hard-metal grades tested were as follows: K04—WC-0.2% VC-4% Co, K07—WC-0.3% VC-0.2% Cr3C2-7% Co, T6—WC-6% Co, B15N—WC-6.5% Co. The diamond-containing hard-metals tested were as follows: D53-DEC20—the hard-metal matrix of 50 wt. % Co, 13 wt. % Cr3C2, 3 wt. % Si, 34 wt. % WC comprising 20 vol. % diamond; D54-DEC20—the hard-metal matrix of 35 wt. % Co, 9 wt. % Cr3C2, 2 wt. % Si, 54 wt. % WC comprising 20 vol. % diamond; D53-DEC30—the same hard-metal matrix as in D53-DEC20 but comprising 30 vol. % diamond. The results are set out in FIG. 4. From this Figure, it is apparent that the wear-resistance of the diamond-containing hardmetals is nearly two orders of magnitude higher than that of the conventional hardmetals. Further from FIG. 5, it can be seen that the wear of the diamond-containing hardmetals is significantly lower than that of the conventional hardmetals.

The invention claimed is:

1. A hard-metal comprising at least 13 volume % of a metal carbide selected from the group consisting of TiC, VC, ZrC, NbC, MoC, HfC, TaC, WC or a combination thereof, and a binder phase having a liquidus temperature of 1280 degrees C. or lower, the binder phase comprising one or more of iron-group metals or alloy thereof, 0.1 to 10 weight % Si, 0.1 to 10 weight % Cr, 1 to 20 weight % of dissolved carbon, and 3 to 39 volume % of diamond or cBN grains coated with a protective coating or a mixture thereof.

2. A hard-metal according to claim 1 wherein the protective coating comprises a single layer or multilayers consisting of a metal or metals of the lVa to Vla groups of the periodic table and/or their carbides, carbonitrides or nitrides, the coating having an average thickness of at least 0.2 μm.

3. The hard-metal according to claim 1 wherein the liquidus temperature of the binder phase is less than 1160 degrees C.

4. The hard-metal according to claim 1 wherein the Cr is present in the form of a chromium carbide and/or a solid solution in the binder phase.

5. The hard-metal according to claim 4 wherein the Cr is present in the form of a metal Cr complex carbide $(Me,Cr)_xC_y$ where Me is Fe, Co and/or Ni, x is 1 to 23 and y is 1 to 6.

6. The hard-metal according to claim 1 wherein the Si is present in the form of a solid solution in the binder phase.

7. The hard-metal according to claim 1 wherein the Si is present in the form of a silicide of Co, Ni and/or Fe.

8. The hard-metal according to claim 1 wherein the binder phase additionally comprises up to 10 weight % of B, Al, S and/or Re.

9. The hard-metal according to claim 1 wherein the diamond and/or cBN grains have average size within the range of 1 to 500 microns.

10. The hard-metal according to claim 1 wherein the binder phase is a low, medium or high-alloyed steel.

11. The hard-metal according to claim 1 having a density equal to or higher than 99.5% of the theoretical density.

12. The hard-metal according to claim 1 which includes a microstructure comprising:

rounded grains of $(Cr,Me)_xC_y$ of average size within the range of 1 to 30 μm, wherein Me is Fe, Co, and/or Ni, x is 1 to 23 and y is 1 to 6;

a carbide phase of either rounded or facetted grains of average size within the range of 0.2 to 20 μm; and a metal based phase consisting of a solid solution of C, Cr, Si and components of the carbide phase in Me, where Me is Fe, Co and/or Ni.

13. The hard-metal according to claim 12 wherein the rounded grains of $(Cr,Me)_xC_y$ have a brown or yellow colour on a metallurgical cross-section after etching in Murakhami reagent at room temperature for 5 minutes or longer.

14. A process for making the hard-metal according to claim 1 including the steps of:

forming a blend of powders comprising at least 13 volume % of a metal carbide, 0.1 to 10 weight % Si, 0.1 to 10 weight % Cr, 1 to 20 weight % dissolved carbon, and one or more iron-group metals or alloy thereof;

admixing diamond or cBN grains coated with a protective coating into the blend of powders to form an admixture;

compacting the admixture to form a green article; and sintering the green article at less than atmospheric pressure or in an inert atmosphere at an elevated temperature not greater than 1250 degrees C. for 30 seconds to 5 minutes.

15. A process according to claim 14 wherein the sintering time is 30 seconds to 3 minutes.

16. A process according to claim 15 wherein the sintering time is 30 seconds to 2 minutes.

17. A process according to claim 14 wherein the sintering temperature is no greater than 1160 degrees C.

* * * * *